US008028934B2

(12) United States Patent
Wurz et al.

(10) Patent No.: US 8,028,934 B2
(45) Date of Patent: Oct. 4, 2011

(54) TWO-SUBSTANCE ATOMIZING NOZZLE

(75) Inventors: Dieter Wurz, Baden-Baden (DE); Stefan Hartig, Achern (DE)

(73) Assignee: Dieter Wurz, Baden-Baden (DE)

( * ) Notice: Subject to any disclaimer, the term of this patent is extended or adjusted under 35 U.S.C. 154(b) by 533 days.

(21) Appl. No.: 12/083,136

(22) PCT Filed: Oct. 6, 2006

(86) PCT No.: PCT/EP2006/009668

§ 371 (c)(1),
(2), (4) Date: Apr. 3, 2008

(87) PCT Pub. No.: WO2007/042210

PCT Pub. Date: Apr. 19, 2007

(65) Prior Publication Data

US 2009/0166448 A1 Jul. 2, 2009

(30) Foreign Application Priority Data

Oct. 7, 2005 (DE) ..... 10 2005 048 489

(51) Int. Cl.
*F23D 11/16* (2006.01)

(52) U.S. Cl. ..... 239/434; 239/419; 239/419.5

(58) Field of Classification Search ..... 239/419, 239/424, 434, 290, 291, 398, 399, 402–404, 239/406, 407, 413, 419.5
See application file for complete search history.

(56) References Cited

U.S. PATENT DOCUMENTS

| | | | | |
|---|---|---|---|---|
| 1,451,063 A | | 4/1923 | Anthony | |
| 4,341,347 A | * | 7/1982 | DeVittorio | 239/3 |
| 5,447,567 A | * | 9/1995 | Tanaka et al. | 118/303 |
| 5,647,538 A | * | 7/1997 | Richardson | 239/405 |
| 5,681,162 A | | 10/1997 | Nabors, Jr. et al. | |
| 5,899,387 A | * | 5/1999 | Haruch | 239/296 |
| 5,964,418 A | * | 10/1999 | Scarpa et al. | 239/424 |
| 6,161,778 A | * | 12/2000 | Haruch | 239/290 |
| 2004/0061001 A1 | * | 4/2004 | Mao et al. | 239/398 |
| 2005/0242209 A1 | | 11/2005 | Holm et al. | |

FOREIGN PATENT DOCUMENTS

| | | |
|---|---|---|
| DE | 2 005 972 | 9/1971 |
| FR | 1 125 303 | 10/1956 |
| RU | 2 243 036 C1 | 12/2004 |
| WO | WO 03/006879 A1 | 9/1971 |
| WO | WO/2004/000109 | 12/2003 |
| WO | WO/2004/096446 | 11/2004 |
| WO | WO 2004/096446 A1 | 11/2004 |

OTHER PUBLICATIONS

Examination Report from the Russian Patent Office dated Sep. 6, 2010 (3 pages). International Search Report dated Jan. 15, 2007 (5 pages).
Written Opinion of International Searching Authority (6 pages).
Office Action in corresponding China application dated Jan. 27, 2011 including English translation (8 pages).
German language EPO Office Action dated May 4, 2011 (5 pages) with partial English translation (1 page).

* cited by examiner

*Primary Examiner* — David Hwu
(74) *Attorney, Agent, or Firm* — Flynn, Thiel, Boutell & Tanis, P.C.

(57) ABSTRACT

An atomizing nozzle for two substances, which is used for spraying a liquid with the aid of a compressed gas, is provided. The atomizing nozzle includes a mixing chamber, a liquid inlet that extends into the mixing chamber, a compressed gas inlet which extends into the mixing chamber, and an outlet located downstream from the mixing chamber. An annular gap is provided which surrounds the outlet and discharges compressed gas at a high speed. The atomizing nozzle is used for purifying flue gas.

20 Claims, 4 Drawing Sheets

TWO-SUBSTANCE ATOMIZING NOZZLE

FIELD OF THE INVENTION

The invention relates to a two-substance atomizing nozzle for spraying a liquid with the aid of a compressed gas, comprising a mixing chamber, a liquid inlet opening out into the mixing chamber, a compressed gas inlet opening out into the mixing chamber and an outlet opening downstream of the mixing chamber.

BACKGROUND OF THE INVENTION

In many process engineering installations, liquids are distributed in a gas. In such cases, it is often of decisive importance that the liquid is sprayed in drops that are as fine as possible. The finer the drops, the greater the specific surface area of the drops. This can give rise to considerable process engineering advantages. For example, the size of a reaction vessel and its production costs depend considerably on the average drop size. However, it is often by no means adequate for the average drop size to be below a certain limit value. Even a few significantly larger drops can lead to considerable operational malfunctions. This is the case in particular whenever the drops do not evaporate quickly enough on account of their size, so that drops or even pasty particles are deposited in downstream components, for example on filter fabrichoses or fan blades, and lead to operational malfunctions due to encrustations or corrosion.

In order to spray liquids finely, either high-pressure one-substance nozzles or medium-pressure two-substance nozzles are used. An advantage of two-substance nozzles is that they have relatively large flow cross sections, so that even liquids containing coarse particles can be sprayed.

The representation of FIG. 1 shows a two-substance nozzle with internal mixing according to the prior art. A basic problem with such nozzles results from the fact that the walls of the mixing chamber 7 are wetted with liquid. The liquid which wets the wall in the mixing chamber 7 is driven to the nozzle mouth as a liquid film 20 by the shearing stress and compressive forces. It is tempting to assume that the walls toward the nozzle mouth are blasted dry because of the high flow velocity of the gas phase, and that only very fine drops are thereby formed from the liquid film. However, theoretical and experimental work by one of the inventors, have shown that liquid films on walls may still exist as stable films without drop formation even when the gas flow that drives the liquid films to the nozzle mouth reaches supersonic speed. And this is indeed also the reason why it is possible to use liquid film cooling in rocket thrust nozzles.

The liquid films 20 that are driven by the gas flow to the nozzle mouth 8 may even migrate around a sharp edge at the nozzle mouth on account of the adhesive forces. They form a bead of water 12 on the outside of the nozzle mouth 8. Outer drops 13, the diameter of which is many times the average diameter of the drops in the jet core or the core jet 21, break away from this bead of water 12. And although these large outer drops only contribute to a small proportion of the mass, they are ultimately determinative for the dimensions of a vessel in which, for example, the temperature of a gas is to be lowered by evaporative cooling from 350° C. to 120° C. without drops entering a downstream fan or downstream fabric filter.

A liquid is introduced into the prior-art nozzle represented in FIG. 1 in the direction of the arrow 1, parallel to a center longitudinal axis 24. The liquid is passed through a lance tube 2, extending concentrically with respect to the center longitudinal axis 24, and enters a mixing chamber 7 at a liquid inlet 10. The lance tube 2 and the mixing chamber 7 are concentrically surrounded by an annular chamber 6, which is formed by means of a further lance tube 4 for the feeding of the compressed gas to the two-substance nozzle. Compressed gas is introduced into this annular chamber 6 according to the arrow 15. A circumferential wall of the mixing chamber 7 that is radial with respect to the center longitudinal axis 24 has a number of compressed gas inlets 5, which are arranged radially with respect to the center longitudinal axis 24. Through these compressed gas inlets 5, compressed gas can enter the mixing chamber 7 at right angles to the liquid jet entering through the liquid inlet 10, so that a liquid/air mixture is formed in the mixing chamber 7. The mixing chamber 7 is adjoined by a frustoconical constriction 3, which forms a convergent outlet portion, which is followed after an extremely narrow cross section 14 in turn by a frustoconical widening 9, which forms a devergent outlet portion. The frustoconical widening 9 ends at the outlet opening or the nozzle mouth 8.

SUMMARY OF THE INVENTION

The invention is intended to provide a two-substance atomizing nozzle with which a uniformly fine drop spectrum can be achieved both in the outer region and in the jet core.

Provided for this purpose according to the invention is a two-substance atomizing nozzle for spraying a liquid with the aid of a compressed gas, comprising a mixing chamber, a liquid inlet opening out into the mixing chamber, a compressed gas inlet opening out into the mixing chamber and an outlet opening downstream of the mixing chamber, in which nozzle an annular gap surrounding the outlet opening is provided for compressed gas to be discharged at high speed.

By providing the annular gap that surrounds the outlet opening and is subjected to atomizing gas, for example air or water vapor, a liquid film on the wall of the nozzle mouth, in particular the divergent outlet portion, is drawn out into a very thin liquid lamella, which breaks down into small drops. In this way, the formation of large drops from liquid films on the wall in the nozzle outlet region can be prevented or reduced to an acceptable degree, and at the same time the fine drop spectrum in the jet core can be maintained, without the compressed gas consumption of the two-substance nozzle or the associated self-energy requirement having to be increased for this. Experimental studies conducted by the inventors have shown that provision of an annular gap allows the maximum drop size to be reduced to about a third for the same expenditure of energy. This may be considered to be a minor effect. However, it must be borne in mind that the volume of a drop of a diameter reduced by a factor of 3 is only one twenty seventh of that of the large drop. Without going here into the interrelated aspects that are known to all, it should be clear to a person skilled in the art that this gives rise to considerable advantages with respect to the required overall volume of evaporative coolers or sorption systems, for example for flue-gas purification. With the additional annular-gap atomization, a much finer drop spectrum can therefore be produced with the same expenditure of energy. The amount of air passed through the annular gap is advantageously 10% to 40% of the total amount of air that is atomized. In process engineering installations in which atomized substances are introduced into vessels or channels that are at approximately the same pressure as the surroundings (1 bar), the total pressure of the air in the annular gap is advantageously 1.5 bar to 2.5 bar absolute. The total pressure of the air in the annular gap should advantageously be at such a level that, when expansion takes place to the pressure level in the vessel, approximately the speed of sound is reached.

In a development of the invention, the outlet opening is formed by means of a peripheral wall, the outermost end of which forms an outlet edge and the annular gap is arranged in the region of the outlet edge.

In this way, the compressed gas discharged from the annular gap at high speed can leave directly in the region of the outlet edge and, as a result, reliably ensure that a liquid film at the nozzle mouth is drawn out into a very thin liquid lamella, which is then divided up into fine drops.

In a development of the invention, the annular gap is formed between the outlet edge and an outer annular gap wall.

In this way, the outlet edge itself can be used for forming the annular gap. This simplifies the structure of the two-substance atomizing nozzle according to the invention.

In a development of the invention, an outer end of the annular gap wall is formed by an annular gap wall edge and the annular gap wall edge is arranged after the outlet edge, as seen in the outflow direction. The annular gap wall edge is advantageously arranged after the outlet edge by between 5% and 20% of the diameter of the outlet opening.

In this way, the creation of coarse liquid drops at the rim of the outlet opening can be prevented particularly reliably.

In a development of the invention, control means and/or at least two compressed gas sources are provided, so that a pressure of the compressed gas supplied to the annular gap and a pressure of the compressed gas entering the mixing chamber through the compressed gas inlet can be set independently of each other.

Separate pipelines for admitting compressed gas to the mixing chamber and for subjecting the annular gap to compressed gas offer advantages to the extent that the pressure in a gap air chamber arranged upstream of the annular gap can then be prescribed independently of the pressure of the atomizing gas that is fed to the mixing chamber. This is of significance with regard to the self-energy requirement if compressors with different back pressures or steam networks with matching different pressures are available in an installation. However, generally only one compressed gas network with a single pressure is available. In this case, pressure reducers may be used for example. When the annular gap is supplied with compressed gas by means of a separate line, the amount of air passed through the annular gap is set by means of separate valves, independently of the amount of air in the core jet that is introduced into the mixing chamber.

In a development of the invention, the mixing chamber is surrounded at least in certain portions by an annular chamber for supplying the compressed gas and a gap air chamber arranged upstream of the annular gap is connected in terms of flow to the annular chamber.

If only one gas network with a single pressure is available, it is necessary to take atomizing gas that is supplied to the annular gap from the same network. The configuration of the two-substance atomizing nozzle can be simplified by taking the atomizing gas that is supplied to the annular gap from the annular space from which the mixing chamber is fed with atomizing gas. Suitable dimensioning of the flow connection between the annular chamber and the gap air chamber allows the energy requirement of the nozzle according to the invention to be minimized. The flow connection is formed, for example, by means of bores in a dividing wall between the annular chamber and the gap air chamber that are to be suitably dimensioned in cross section, including in relation to the bores forming a compressed gas inlet into the mixing chamber.

In a development of the invention, a veil-of-air nozzle which surrounds the outlet opening and the annular gap at least in certain portions is provided.

The provision of a veil-of-air nozzle leads to a further improvement in the spray pattern of the two-substance atomizing nozzle according to the invention; in particular, it is possible to avoid backflow vortices, by which drops and dust-containing gas are mixed together and lead to troublesome deposits at the nozzle mouth.

In a development of the invention, the veil-of-air nozzle has a veil-of-air annular gap which surrounds the outlet opening and the annular gap and the outlet area of which is very much larger than an outlet area of the annular gap. The veil-of-air nozzle is advantageously fed with compressed gas of a pressure that is much lower than a pressure of the compressed gas supplied to the annular gap.

In this way, the veil-of-air nozzle, which encloses the nozzle mouth in an annular form, can be subjected to air at low pressure in an energy-saving manner. This is very important because the veil-of-air annular gap of the veil-of-air nozzle is to be made very much larger than the annular gap for the liquid film atomization to avoid a backflow vortex.

In a development of the invention, means are provided to impart a swirl about a center longitudinal axis of the nozzle to a mixture of compressed gas and liquid in the mixing chamber.

The fact that it is possible with the two-substance atomizing nozzle according to the invention to spray the liquid film that exists on the inner wall in the nozzle outlet part into small drops at the nozzle mouth as a result of the additional annular gap atomization offers further interesting starting points for nozzle design. In particular, it is hereby admissible to impart a swirl to the two-phase flow in the mixing chamber, and consequently also in the outlet part of the nozzle. This does admittedly have the effect that rather more drops are flung onto the inner wall of the outlet part. However, this is not detrimental because of the very efficient annular gap atomization. One advantage of the swirling is that a swirled flow in the mixing chamber and in the outlet part tends to be centrally symmetrical. This can scarcely be achieved with conventional two-substance nozzles with internal mixing and has previously led to the formation of a particularly high number of large drops in certain regions at the nozzle mouth. As a result, the average drop size can be reduced considerably by swirling the core jet.

In a development of the invention, the compressed gas inlet has at least a first inlet bore, which opens into the mixing chamber and is aligned tangentially in relation to a circle around a center longitudinal axis of the nozzle, to produce a swirl in a first direction.

The provision of tangential inlet bores allows a swirl to be produced in the mixing chamber in a way that is simple and scarcely liable to blockage.

In a development of the invention, a number of first inlet bores, in particular four, are provided in a first plane perpendicularly in relation to the center longitudinal axis and spaced apart in the circumferential direction.

An evenly spaced-apart arrangement of such tangential inlet bores allows a clear swirl to be achieved in the mixing chamber.

In a development of the invention, at least a second inlet bore, which is aligned tangentially in relation to a circle around the center longitudinal axis of the nozzle, is provided parallel to the center longitudinal axis and at a distance from the first inlet bore, to produce a swirl in a second direction.

In this way, opposing swirling directions can be imparted to the flow in the mixing chamber in the different planes of the inlet bore or air supply bore. Opposing swirling directions have the effect of producing very pronounced shearing layers in the mixing chamber, contributing to the formation of particularly fine drops.

In a development of the invention, a number of second inlet bores, in particular four, are provided in a second plane perpendicularly in relation to the center longitudinal axis and spaced apart in the circumferential direction.

In a development of the invention, at least three planes with inlet bores are provided, spaced apart parallel to the center longitudinal axis, the inlet bores of successive planes producing an oppositely directed swirl.

For example, a first plane, counting from the liquid inlet, may have left-turning inlet bores, the second plane right-turning inlet bores and the third plane again left-turning inlet bores. The opposing swirling directions have the effect of producing very pronounced shearing layers in the mixing chamber, contributing to the formation of particularly fine drops.

BRIEF DESCRIPTION OF THE DRAWINGS

Further features and advantages of the invention emerge from the claims and the following description of preferred embodiments in conjunction with the drawings. Individual features of the individually represented embodiments can be combined with one another in any way desired without going beyond the scope of the invention. In the drawings:

DETAILED DESCRIPTION

Figure 1:
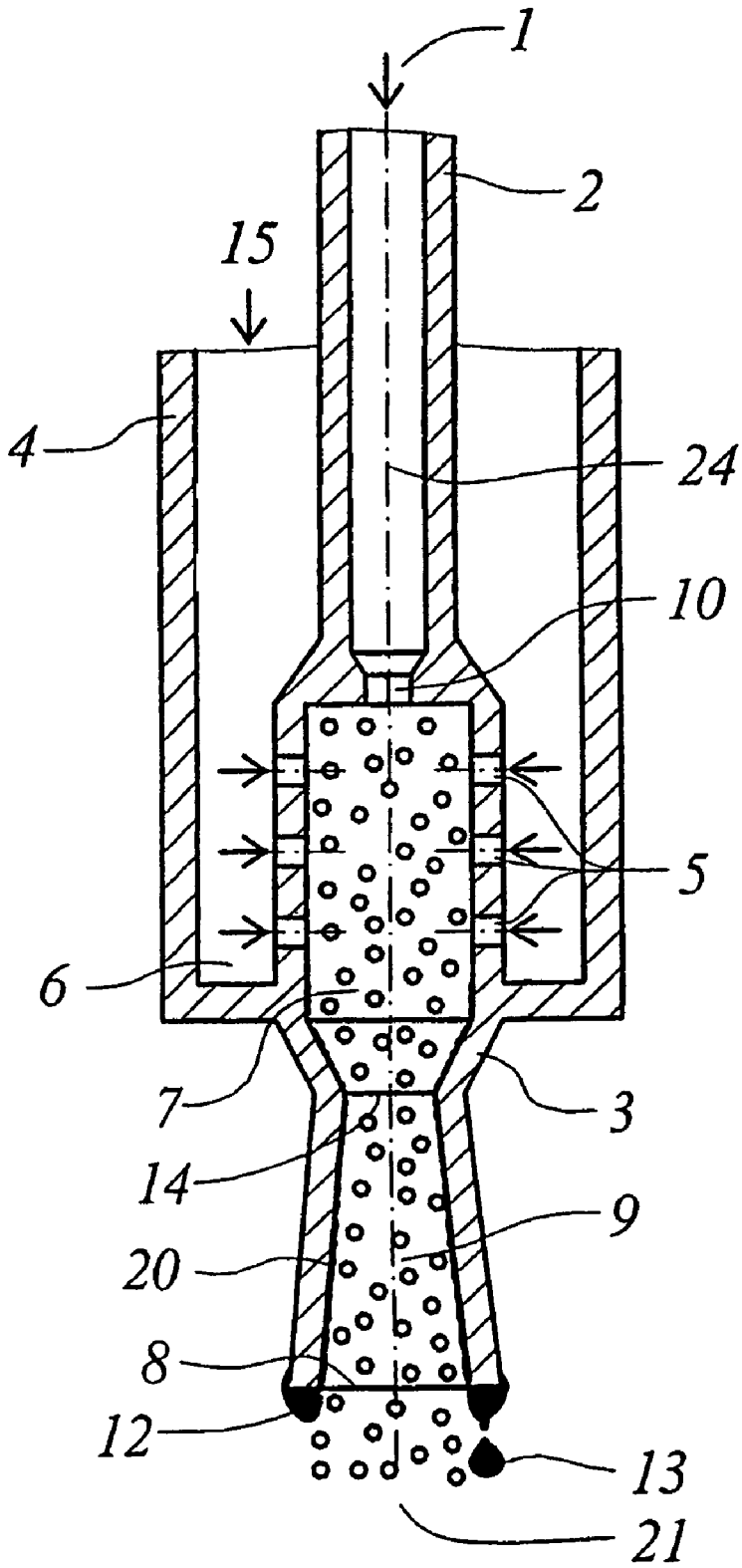
FIG. 1 shows a two-substance atomizing nozzle according to the prior art.
Figure 2:
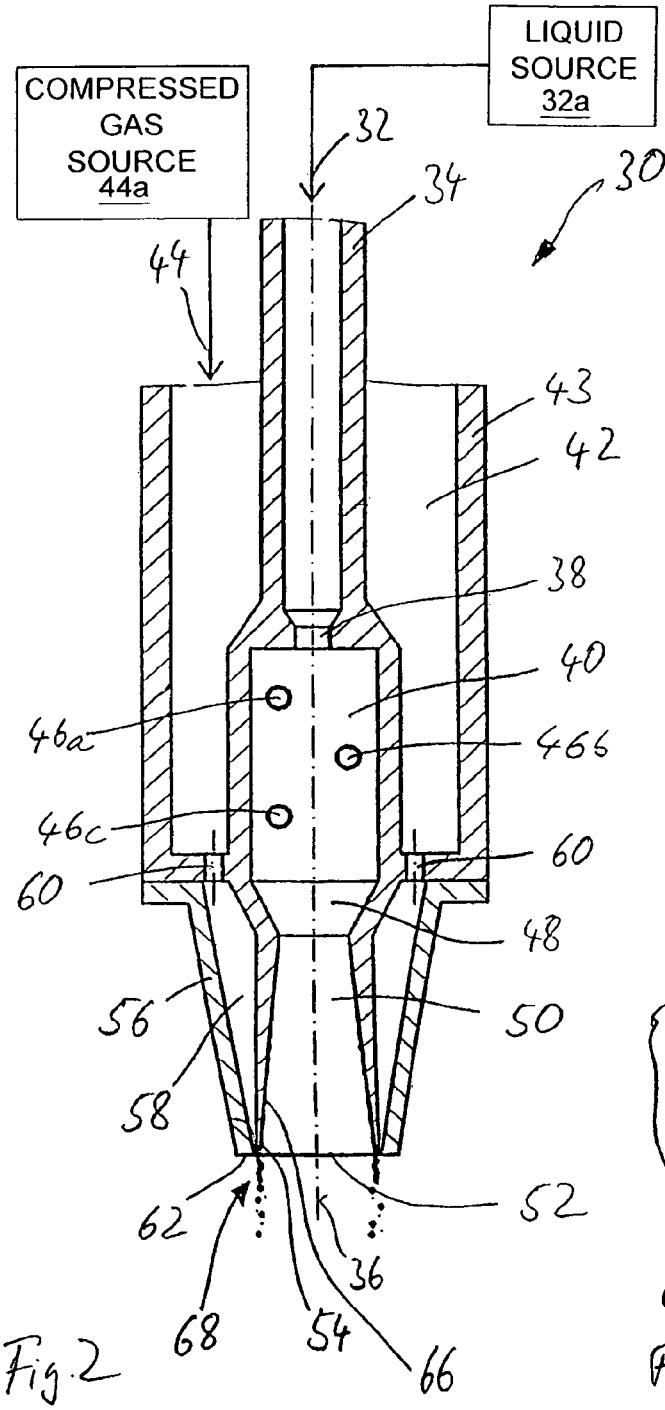
FIG. 2 shows a two-substance atomizing nozzle according to a first embodiment of the invention.

The sectional view of FIG. 2 shows a two-substance atomizing nozzle 30 according to the invention, according to a first preferred embodiment. The two-substance atomizing nozzle 30 according to the invention is constructed in a way similar to the known nozzle according to FIG. 1, at least as far as the introduction of the liquid and the compressed gas into the mixing chamber and the shaping of the nozzle adjoining the mixing chamber are concerned. A liquid to be atomized is supplied in the direction of an arrow 32 from a liquid source 32*a* by way of an inner lance tube 34, which extends parallel to a center longitudinal axis 36 of the nozzle 30, and passes to a liquid inlet 38, which has a reduced cross section in comparison with the tube 34. After passing the liquid inlet 38, the liquid then passes in the form of a liquid jet extending concentrically with respect to the center longitudinal axis 36 into the cylindrical mixing chamber 40 arranged concentrically with respect to the center longitudinal axis 36. The tube 34 and the mixing chamber 40 are surrounded by an annular chamber 42, which is formed by the intermediate space between an outer lance tube 43 and the inner lance tube 34 and into which compressed gas, for example compressed air, is introduced in the direction of an arrow 44 from a source of compressed gas 44*a*. A circumferential wall of the mixing chamber 40 that extends concentrically with respect to the center longitudinal axis 36 has a number of inlet openings 46*a*, 46*b*, 46*c*, all of which together form a compressed gas inlet into the mixing chamber 40, that is to say for supplying what is known as the core air. The compressed gas inlet openings 46 are arranged offset in relation to one another in the direction of the center longitudinal axis 36 and also in the circumferential direction. As a result, compressed gas is introduced into the mixing chamber 40 in different layers. The precise arrangement of the compressed gas inlet openings 46 is further explained below on the basis of FIGS. 4 to 7.

Provided so as to adjoin the mixing chamber 40 is a frustoconical constriction 48, which forms a convergent outlet part and, after passing an extremely narrow cross section, goes over again into a frustoconical widening 50 of a smaller aperture angle, which forms a divergent outlet part. The divergent outlet part ends at an outlet opening 52 or a nozzle mouth. The outlet opening 52 is formed by a peripheral outlet edge 54, which forms the end of the outlet part situated downstream in the direction of flow.

The frustoconical constriction 48 and the frustoconical widening 50 are surrounded by a funnel-like component 56, so that an annular gap air chamber 58 is formed between the funnel-like component 56 and an outer wall of the outlet part. This annular gap air chamber 58 is supplied with compressed gas from the annular chamber 42 by means of a number of inlet bores 60. A lower end of the funnel-shaped component 56 in the representation of FIG. 2 is formed by an annular gap wall edge 62, which runs around the outlet opening 52. Formed between the annular gap wall edge 62 and the outlet edge 54 is an annular gap 64 surrounding the outlet opening 52, which consequently surrounds the outlet opening 52 in an annular form.

Figure 2B:
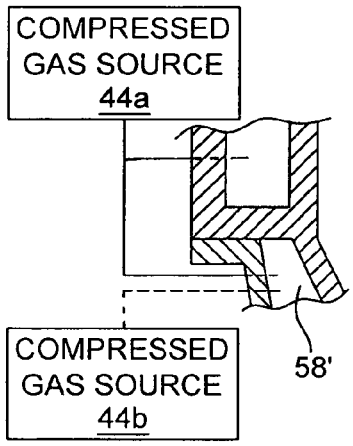
FIG. 2*b* shows an enlarged detail of an alternative embodiment.
Figure 2A:
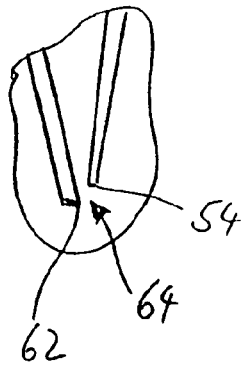
FIG. 2*a* shows an enlarged detail of FIG. 2.

Through this annular gap 64, which is represented once again in an enlarged manner in the representation of FIG. 2*a*, compressed gas is discharged at high speed. In this way, a liquid film 66, which forms on an inner wall of the conical widening 50, is drawn out at the outlet opening 52 of this divergent nozzle outlet part into a very thin liquid lamella 68, which breaks down into small drops. Experimental studies conducted by the inventors have shown that in this way the maximum drop size of the two-substance atomizing nozzle 30 can be reduced to about a third for the same expenditure of energy as compared to the case of the prior-art nozzle according to FIG. 1. The amount of air passed through the annular gap is between 10% and 40% of the total amount of air that is atomized.

As can be seen from the representations of FIGS. 2 and 2*a*, the annular gap outlet edge 62 protrudes somewhat from the outlet edge 54 in the direction of flow. Therefore, a further improvement in the atomization and a guard for the sharp outlet edge 54 are achieved by making the outer annular gap nozzle protrude somewhat beyond the nozzle mouth of the central nozzle. The annular gap outlet edge 62 advantageously protrudes beyond the outlet edge 54 by 5% to 20% of the diameter of the outlet opening As a departure from the embodiment of the atomizing nozzle 30, the annular gap air chamber 58 may be supplied with compressed gas from a separate line. For this purpose, for example, the bores 60 are closed and compressed gas from source 44*a* is introduced directly into the annular gap air chamber 58' from a separate line as shown in FIG. 2*b*. Alternatively, a separate compressed gas source 44*b* may be utilized in addition to source 44*a*, which source 44*b* is connected via a line to chamber 58' as shown in FIG. 2*b* in dotted lines.

Figure 3:
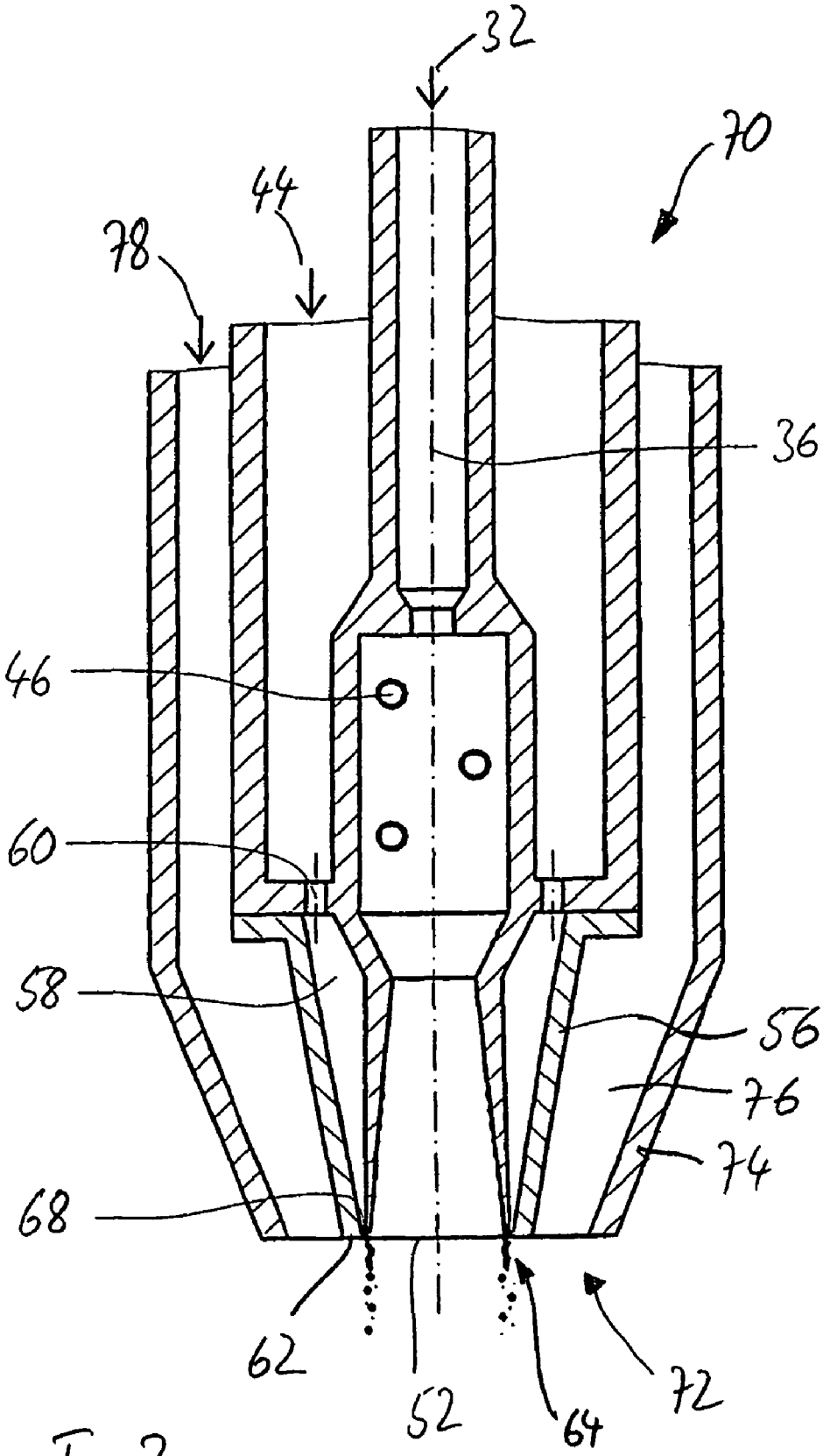
FIG. 3 shows a sectional view of a two-substance atomizing nozzle according to a second preferred embodiment of the invention.

The sectional view of FIG. 3 shows a further two-substance atomizing nozzle 70 according to a second preferred embodiment of the invention. With the exception of an additional veil-of-air nozzle 72, the two-substance atomizing nozzle 70 is constructed in the same way as the two-substance atomizing nozzle 30 of FIG. 2, so that there is no need for a detailed explanation of the basic functional principle and the same components are provided with the same reference numerals.

In the case of the two-substance atomizing nozzle 70, the funnel-shaped component 56 is surrounded by a further component 74, which in principle is constructed in a tubular form, forms a further lance tube and narrows in the manner of a funnel in the direction of the outlet opening 52. In this way, a veil-of-air annular gap 76 is formed between the component 74 and the component 56. The veil-of-air gap 76 ends approximately level with the outlet opening 52 and a lower, peripheral edge of the component 74 is arranged level with the annular gap wall edge 62. However, a cross-sectional area of the veil-of-air gap formed as a result is much larger than the annular gap 64, in order that backflow vortices can be avoided when the veil of air is introduced. The veil-of-air nozzle 72 enclosing the nozzle mouth or the outlet opening 52 in an annular form can be subjected to air at low pressure, which is supplied according to an arrow 78, in an energy-saving manner.

The two-substance atomizing nozzle 30 and the two-substance atomizing nozzle 70 of FIGS. 2 and 3, respectively, may be arranged at the lower end of what is known as an atomizing lance, which protrudes into the process space.

Figure 4:
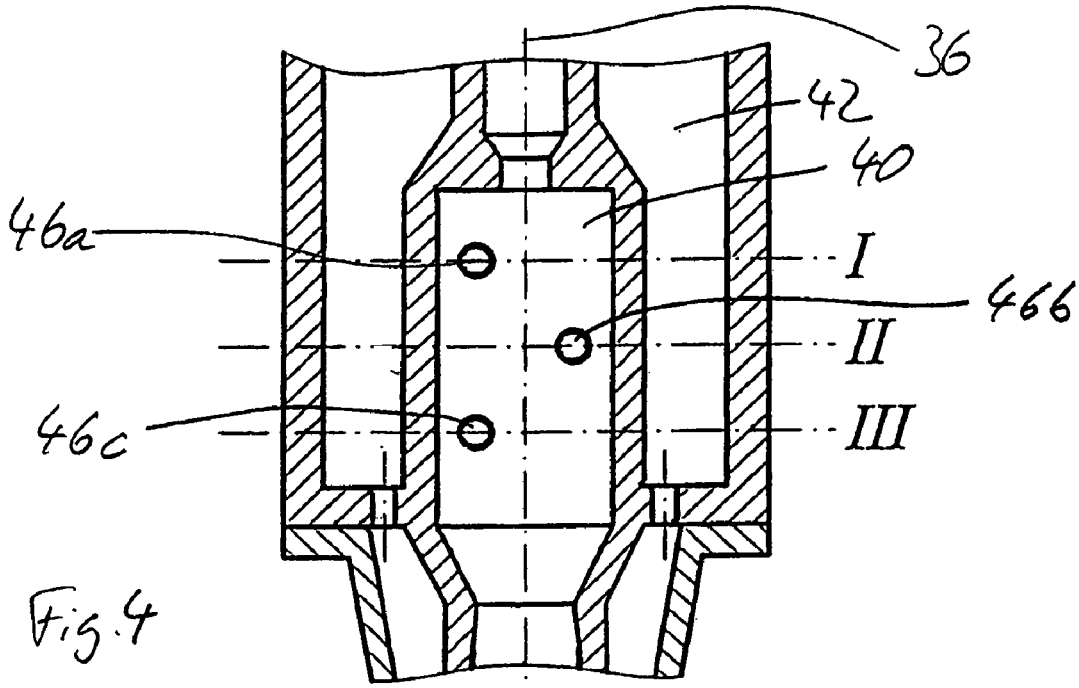
FIG. 4 shows a portion of a sectional view of the nozzle of FIG. 2 in which different sectional planes are marked.

The representation of FIG. 4 shows a portion of a sectional view of the two-substance atomizing nozzle 30 of FIG. 2. Sectional planes that are respectively denoted by I, II and III are taken through the various planes with compressed gas inlet openings 46*a*, 46*b*, 46*c*.

The fact that it is possible with the two-substance atomizing nozzle 30, 70 according to the invention with additional annular gap atomization to spray the liquid film 66 that exists on the inner wall in the divergent nozzle outlet part 50 into small drops at the nozzle mouth offers further interesting starting points for nozzle design. In particular, it is admissible to impart a swirl to the two-phase flow in the mixing chamber 40, and consequently also in the outlet part 48, 50 of the nozzle 30, 70. This does admittedly have the effect that rather more drops are flung onto the inner wall of the outlet part. However, this is not detrimental because of the very efficient additional annular gap atomization. One advantage of the swirling is that a swirled flow in the mixing chamber 40 and in the outlet part 48, 50 tends to be centrally symmetrical. This can scarcely be achieved with conventional two-substance nozzles and has previously led to such nozzles having a tendency to "spit", in that a particularly high number of large drops were formed in certain regions at the nozzle mouth. Previously, the center lines of the air supply bores 5 of the conventional nozzle according to FIG. 1 were aligned with the center longitudinal axis 24 of the two-substance nozzle. It is tempting to assume that a centrally symmetrical flow configuration must result from this. This is not the case, however; rather, even very small disturbances in the supply of liquid or air to the mixing chamber are sufficient to make the jet deviate to the side.

According to the invention, on the other hand, it is envisaged to align the bores for forming the compressed gas inlet openings 46*a*, 46*b*, 46*c* in each case tangentially in relation to a circle around the center longitudinal axis 36 of the nozzle. As a result, the jet that is swirled in this way centers itself of its own accord in the mixing chamber 40 as well as in the convergent outlet part and in the divergent outlet part of the nozzle 30, 70.

Figure 5:
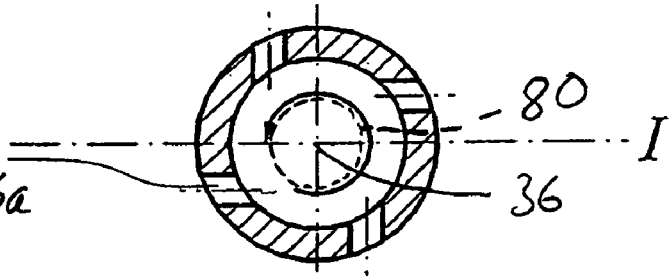
FIG. 5 shows a sectional view of the plane I of FIG. 4.

The tangential alignment of the compressed gas inlet openings 46*a* can be seen more precisely from the sectional view of FIG. 5. Altogether, four bores evenly spaced apart from one another in the circumferential direction, which form a flow connection from the annular chamber 42 into the mixing chamber 40, are arranged in the plane I. All these bores are arranged tangentially in relation to an imaginary circle 80 around the center longitudinal axis 36 of the nozzle. A swirl, which in the representation of FIG. 5 is indicated by means of a circular arrow in the counterclockwise direction, forms as a result in the plane I.

Figure 6:
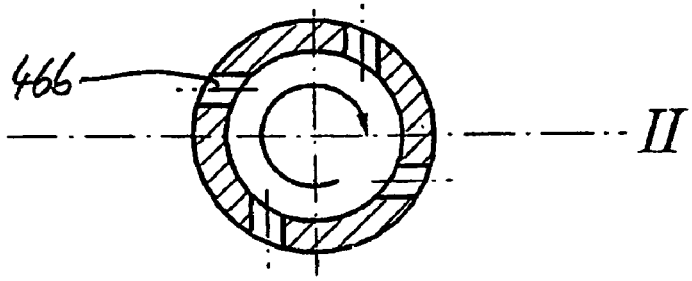
FIG. 6 shows a sectional view of the plane II of FIG. 4

The representation of FIG. 6 shows the arrangement of four bores for the formation of the compressed gas inlet openings 46*b* in the plane II. The compressed gas inlet openings 46*b* are likewise arranged tangentially in relation to a circle around the center longitudinal axis 36 of the nozzle, but in such a way that a flow around the center longitudinal axis 36 in the clockwise direction is obtained in the plane II.

Figure 7:
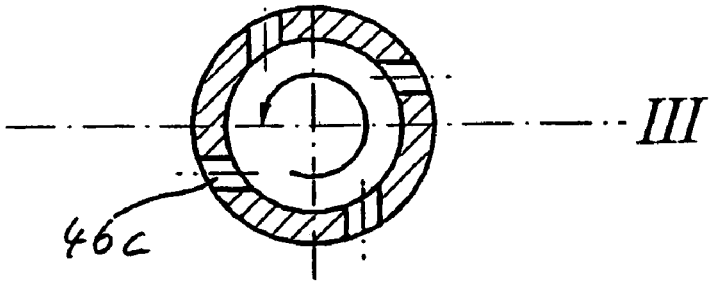
FIG. 7 shows a sectional view of the plane III of FIG. 4.

As can be seen from FIG. 7, the compressed gas inlet openings 46*c* in the plane III are again arranged in the same way as the compressed gas inlet openings 46*a* in the plane I, so that a flow around the center longitudinal axis 36 in the counterclockwise direction is again obtained in the plane III.

According to the invention, it is therefore envisaged to impart opposite directions of swirl to the air supply bores in the different planes I, II, III. So, the first air supply bore plane I, counting from the liquid inlet, is arranged so as to be left-turning, the second bore plane II right-turning and the third bore plane again left-turning. The opposing swirling directions in the different planes I, II, III have the effect of producing very pronounced shearing layers in the mixing chamber 40, contributing to the formation of particularly fine drops.

Furthermore, the two-substance atomizing nozzles 30, 70 may be optimized by the solid liquid jet that enters the mixing chamber being divided up even before it interacts with the atomizing air. This can take place in various ways that are in themselves conventional, for example by providing baffle plates, swirl inserts and the like.

The invention claimed is:

1. A two-substance atomizing nozzle for spraying a liquid with the aid of a compressed gas, said nozzle having a longitudinal axis and comprising:

a mixing chamber;

a liquid inlet in communication with a source of liquid and opening into said mixing chamber;

a gas inlet in communication with a source of compressed gas, said gas inlet opening into said mixing chamber such that pressurized gas flows from said gas inlet and into said mixing chamber and mixes with liquid in said mixing chamber;

an outlet adjoining said mixing chamber and being disposed downstream of said mixing chamber in a liquid supply direction, said outlet including a first outlet part which converges inwardly towards the axis as said first outlet part extends in the liquid supply direction and a second outlet part disposed downstream of said first outlet part in the liquid supply direction, said second outlet part diverging outwardly away from the axis as said second outlet part extends in the liquid supply direction, said second outlet part terminating at an outlet opening disposed downstream of said mixing chamber in the liquid supply direction, said outlet being disposed to guide a stream of liquid mixed with compressed gas from said mixing chamber to said outlet opening; and an annular gap surrounding said outlet opening and in communication with a source of compressed gas, said annular gap being disposed and configured to discharge pressurized gas at a high speed adjacent said outlet opening to draw out a liquid film located on an inner wall of said second outlet part into thin liquid lamellas which break into small drops.

2. The two-substance nozzle of claim 1, further including a component defining a peripheral wall disposed in surrounding relation with said second outlet part and having a terminal downstream end which defines a terminal edge, said second outlet part having a downstream terminal outlet edge which defines said outlet opening, said terminal edge of said component being spaced radially outwardly from said outlet edge of said second outlet part to define said annular gap therebetween.

3. The two-substance nozzle of claim 2, wherein said terminal edge of said component extends axially beyond said outlet edge of said second outlet part in the liquid supply direction.

4. The two-substance nozzle of claim 3, wherein said terminal edge of said component extends axially beyond said outlet edge of said second outlet part by an amount between 5% and 20% of a diameter of said outlet opening.

5. The two-substance nozzle of claim 2, further including an inner tube defining said mixing chamber therein and having a downstream end adjoining an upstream end of said first outlet part of said outlet, said gas inlet being defined in said inner tube, and an outer tube defining a first chamber at least partially surrounding said inner tube and in communication with a source of compressed gas, said peripheral wall of said component defining a second chamber disposed upstream of said annular gap and in communication therewith, and an inlet bore extending between said first and second chambers to permit compressed gas flow from said first chamber to said second chamber.

6. The two-substance nozzle of claim 1, further including a source of compressed gas in communication with both said gas inlet and said annular gap, wherein said source of compressed gas is connected to said gas inlet and said annular gap by one of: a single line; and respective separate lines.

7. The two-substance nozzle of claim 1, further including a first source of compressed gas in communication with said gas inlet and a second source of compressed gas in communication with said annular gap, said first and second sources of compressed gas being independent from one another such that pressures of compressed gas supplied to said gas inlet and to said annular gap are set independently from one another.

8. The two-substance nozzle of claim 1, further including an inner tube defining said mixing chamber therein and having a downstream end adjoining an upstream end of said first outlet part of said outlet, said gas inlet including an inlet bore disposed in said inner tube to impart a swirl about the axis to a mixture of compressed gas and liquid in said mixing chamber.

9. The two-substance nozzle of claim 8, wherein said inlet bore opens into said mixing chamber and is oriented tangentially to an imaginary circle centered on the axis to produce a swirl in a first direction about the axis to a mixture of compressed gas and liquid in said mixing chamber.

10. The two-substance nozzle of claim 9, wherein said gas inlet includes a plurality of said inlet bores which are first inlet bores, said first inlet bores all being oriented in a first plane oriented perpendicular to the axis, said first inlet bores being circumferentially spaced from one another about the axis.

11. The two-substance nozzle of claim 10, wherein said gas inlet includes a plurality of second inlet bores opening into said mixing chamber and oriented tangentially to an imaginary circle centered on the axis to produce a swirl in a second direction about the axis opposite to the first direction, said second inlet bores all being oriented in a second plane oriented perpendicular to the axis and spaced axially from the first plane, said second inlet bores being circumferentially spaced from one another about the axis.

12. The two-substance nozzle of claim 11, wherein said gas inlet includes a plurality of third inlet bores opening into said mixing chamber and oriented tangentially to an imaginary circle centered on the axis to produce a swirl in the first direction, said third inlet bores all being oriented in a third plane oriented perpendicular to the axis and spaced axially from the first and second planes, said third inlet bores being circumferentially spaced from one another about the axis and the second plane of said second inlet bores being disposed axially between the first and third planes.

13. The two-substance nozzle of claim 1, further including a veil-of-air nozzle disposed in at least partially surrounding relation with said outlet opening and said annular gap.

14. The two-substance nozzle of claim 13, further including a component defining a peripheral wall disposed in surrounding relation with said second outlet part and having a terminal downstream end which defines a terminal edge, said second outlet part having a downstream terminal outlet edge which defines said outlet opening, said terminal edge of said component being spaced radially outwardly from said outlet edge of said second outlet part to define said annular gap therebetween, said veil-of-air nozzle having a terminal downstream edge spaced radially outwardly from said terminal edge of said component to define a veil-of-air annular gap in communication with a source of compressed gas, said veil-of-air annular gap being larger than said annular gap.

15. The two-substance nozzle of claim 13, wherein said veil-of-air nozzle is fed with compressed gas of a pressure lower than a pressure of compressed gas supplied to said annular gap.

16. The two-substance nozzle of claim 1, further including a component having a peripheral wall disposed in at least partially surrounding relation with said second outlet part, said peripheral wall having a downstream end defining a terminal edge, said second outlet part having a downstream terminal edge which defines said outlet opening, said terminal edge of said peripheral wall being spaced radially from said terminal edge of said second outlet part to define said annular gap therebetween, said peripheral wall having a frusto-conical configuration which diverges inwardly towards the axis as said peripheral wall extends in the liquid supply direction.

17. The two-substance nozzle of claim 16, wherein said peripheral wall of said component is spaced radially outwardly from said second outlet part to define a chamber therebetween in communication with a source of compressed gas, said chamber being disposed upstream of and in communication with said annular gap to supply pressurized gas thereto.

18. A two-substance atomizing nozzle for spraying a liquid with the aid of a compressed gas, the nozzle comprising:

a mixing chamber;

a liquid inlet opening out into the mixing chamber;

a compressed gas inlet opening out into the mixing chamber;

an outlet opening downstream of the mixing chamber, the outlet opening being formed by a peripheral wall, an outermost end of the peripheral wall forming an outlet edge; and an annular gap arranged in a region of the outlet edge and surrounding the outlet opening for discharging compressed gas at high speed, the annular gap being formed between the outlet edge and an outer annular gap wall having an outer end forming an annular gap wall edge, the annular gap wall edge being arranged downstream of the outlet edge in an outflow direction by between 5% and 20% of a diameter of the outlet opening.

19. A two-substance atomizing nozzle for spraying a liquid with the aid of a compressed gas, said nozzle defining a central longitudinal axis and comprising:

a first tubular component defining a mixing chamber therein and having a liquid inlet in communication with a source of liquid, said first tubular component defining therein a gas inlet in communication with a source of compressed gas, both said liquid inlet and said gas inlet opening into said mixing chamber to cause both liquid and pressurized gas to flow into said mixing chamber and to mix with one another within said mixing chamber;

a second tubular component adjoining said first tubular component and being disposed downstream of said mixing chamber in a liquid supply direction, said second tubular component having a first part with a frusto-conical configuration which diverges inwardly as same projects along the axis in the liquid supply direction, and a second part adjoining said first part and being disposed downstream thereof, said second part having a frusto-conical configuration which diverges outwardly as same projects along the axis in the liquid supply direction, said second part having a downstream end which terminates at a nozzle opening disposed downstream of said mixing chamber for discharging a stream of liquid mixed with compressed gas from said mixing chamber; and a third tubular component disposed adjacent said nozzle opening, said third tubular component defining a chamber therein in communication with a source of compressed gas and having a terminal downstream end spaced from said downstream end of said second part to define an annular gap disposed in surrounding relation with said nozzle opening to discharge compressed gas at a high speed adjacent said nozzle opening and draw out a liquid film located on an inner wall of said second part into thin liquid lamellas.

20. The two-substance nozzle of claim 19, wherein said second part of said second tubular component is disposed within said third tubular component, said third tubular component having a frusto-conical configuration which diverges inwardly towards the axis as said third tubular component projects along the axis in the liquid supply direction.

* * * * *